United States Patent [19]

Torrenteras et al.

[11] 4,355,492

[45] Oct. 26, 1982

[54] APPARATUS FOR AUTOMATICALLY BOXING CYLINDRICAL GOODS

[76] Inventors: Angel E. Torrenteras, Avenue du Roi Albert, 176; Antonio E. Torrenteras, Kruipweg, 66, both of Brussels, Belgium

[21] Appl. No.: 130,333

[22] Filed: Mar. 14, 1980

[30] Foreign Application Priority Data

Mar. 16, 1979 [BE] Belgium ..... 0/194069
Nov. 5, 1979 [BE] Belgium ..... 0/197970

[51] Int. Cl.[3] ..... B65B 5/10; B65B 57/20

[52] U.S. Cl. ..... 53/58; 53/251; 53/501; 53/564; 53/574

[58] Field of Search ..... 53/501, 500, 58, 236, 53/244, 251, 250, 564, 566, 574

[56] References Cited

U.S. PATENT DOCUMENTS

| | | | |
|---|---|---|---|
| 2,590,823 | 3/1952 | Rhodes | 53/58 |
| 2,919,531 | 1/1960 | Molins et al. | 53/236 |
| 3,482,372 | 12/1969 | Hottendorf | 53/58 X |
| 3,730,386 | 5/1973 | Monsees | 53/500 X |
| 3,815,321 | 6/1974 | Hartman | 53/500 |
| 3,842,573 | 10/1974 | Price | 53/501 X |

*Primary Examiner*—James F. Coan
*Attorney, Agent, or Firm*—Cushman, Darby & Cushman

[57] ABSTRACT

There is described an apparatus for automatically boxing cylindrical goods with the same size, with means for aligning said goods and move same by gravity to a filling station, as well as means for discharging the filled boxes. A suitable box is also described.

29 Claims, 9 Drawing Figures

APPARATUS FOR AUTOMATICALLY BOXING CYLINDRICAL GOODS

This invention has for object an apparatus for automatically boxing cylindrical goods, particularly coin rolls, which is to be fed by at least one machine manufacturing such cylindrical goods the dimensions of which are equal.

Many goods are manufactured automatically while the conditioning thereof is still made by hand. The invention has for object to obviate said drawback and to provide an apparatus with a simple and cheap structure which allows to automatize the boxing of cylindrical goods, particularly coin rolls.

For this purpose according to the invention, said apparatus comprises means to align said goods along the axis thereof and to move same in aligned condition, in parallel relationship with said axis, means to change the movement direction of said goods and so arranged as to align same by gravity with the axes thereof in parallel relationship and to move said goods at right angle to said axes, means to arrange one by one empty prefabricated boxes on the goods path as said goods move by gravity at right angle to the axes thereof, means to immobilize temporarily a box during the filling thereof, means controlled by a counting mechanism driven by the passage of said goods, and so arranged as to release by gravity a filled box and to operate said means to replace the filled box by an empty box, and means to discharge the filled box.

The invention has also for object a box with a quadrangular bottom, particularly a box to be used in said apparatus, the blank of which is so cut-out that the box be foldable to let those elements comprising the bottom fold back against the side walls inside same, when said side walls are brought together two by two relative to a plane at right angle to the bottom and passing through a diagonal thereof.

According to the invention, those elements comprising the bottom are so cut-out that when the box lies in folded condition, two side walls connected along an edge lying in that plane passing through said diagonal can contact directly one another adjacent said edge.

Other details and features from the invention will stand out from the description given below by way of non limitative example and with reference to the accompanying drawings, in which.

In the various figures, the same reference numerals pertain to similar components.

Figure 1:
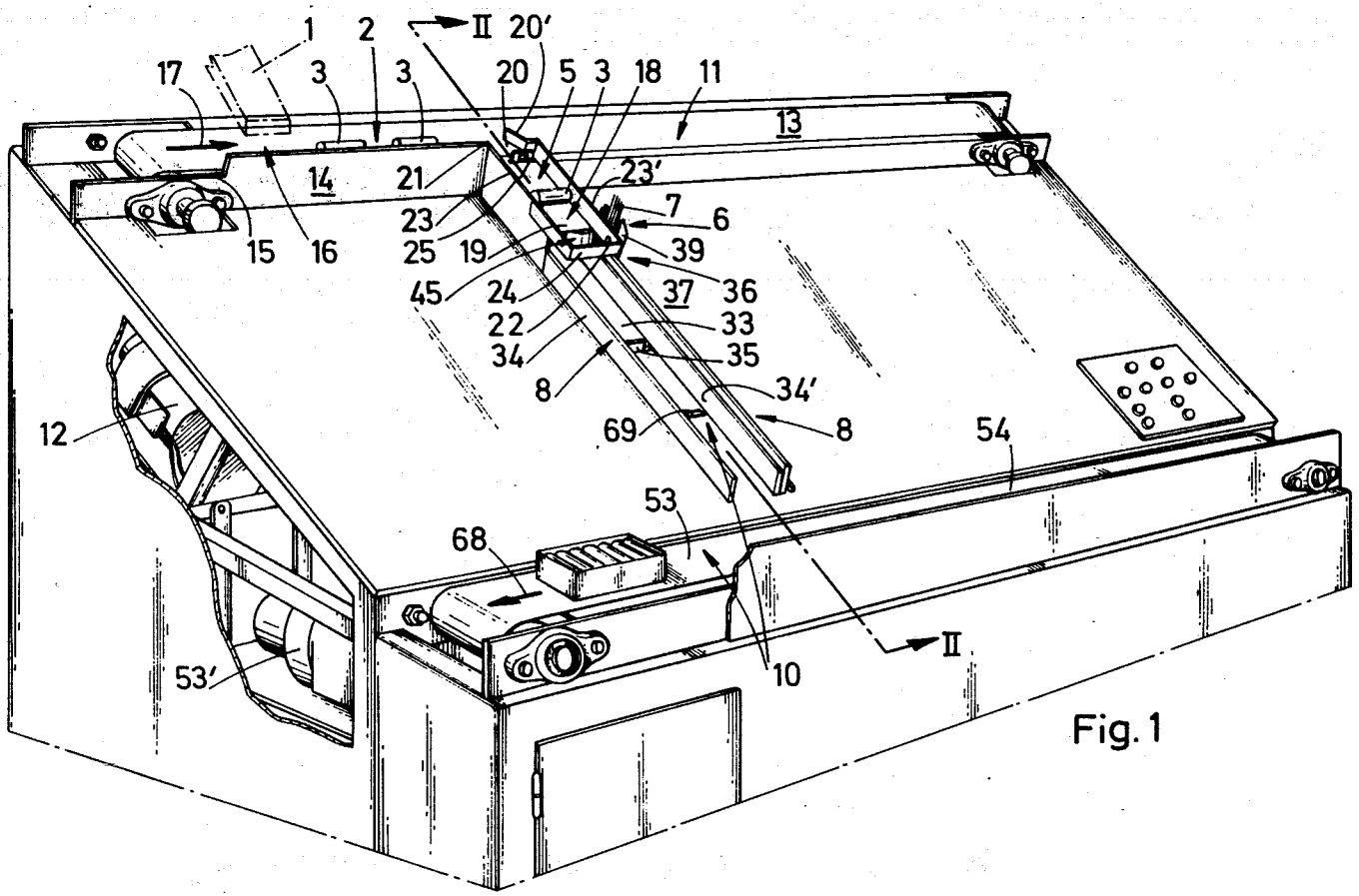
FIG. 1 is a perspective view with parts broken away, of an apparatus according to the invention.
Figure 2:
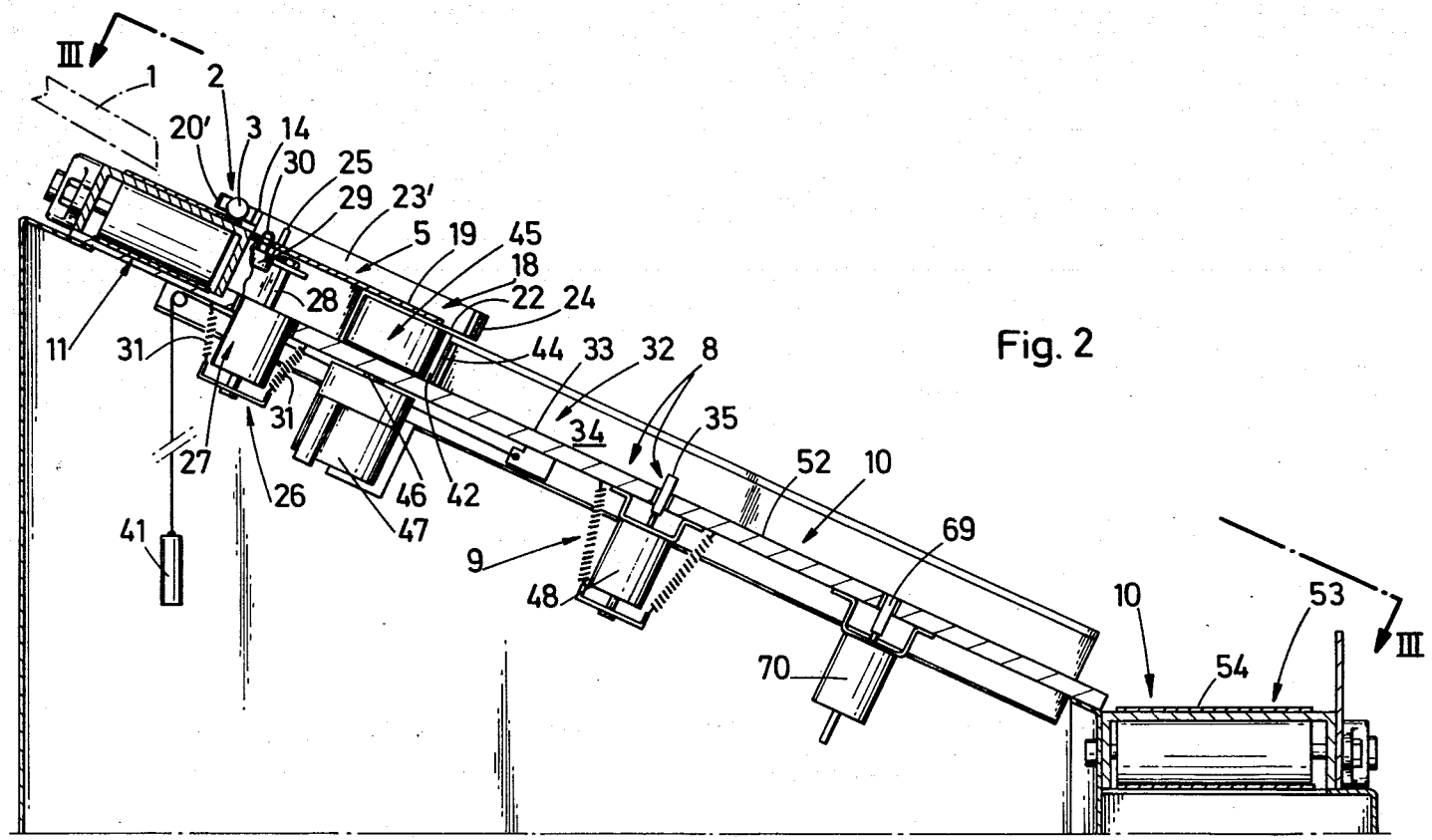
FIG. 2 is a cross-section along line II—II in FIG. 1.
Figure 3:
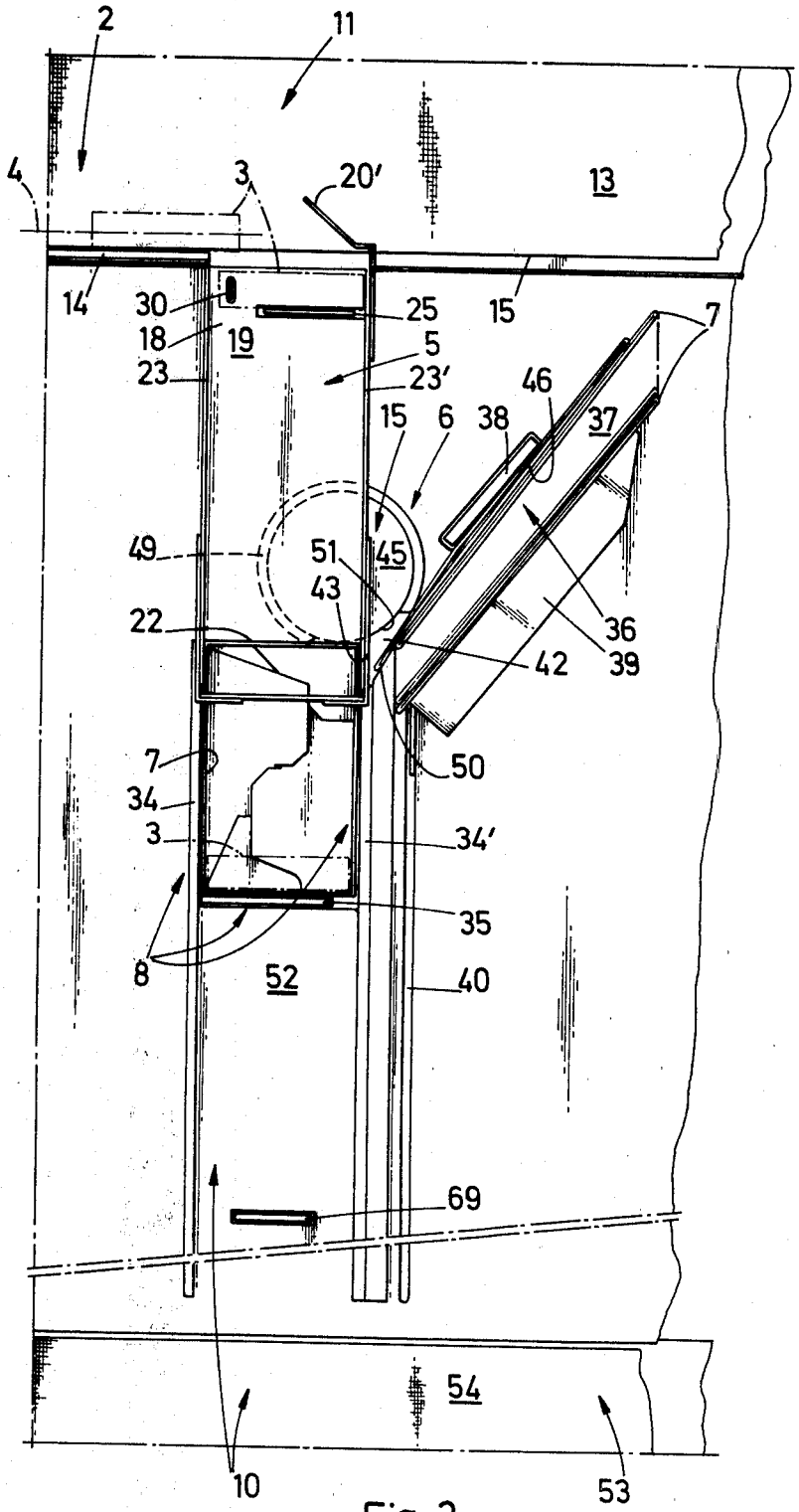
FIG. 3 is a view along line III—III in FIG. 2 with parts broken away and on a larger scale than FIG. 2, from a detail of the apparatus shown in FIGS. 1 and 2.

The apparatus according to the invention and shown in FIGS. 1 to 3 allows to box automatically cylindrical goods, particularly coin rolls, the dimensions of which are equal. In this apparatus to allow boxing rolls with different lengths and diameters, it is necessary to provide units arranged in parallel relationship which each treat rolls the sizes of which are equal, each such unit being fed by a machine producing rolls with a size corresponding to the roll size said unit can operate on.

For automatically boxing coin rolls with the same size, each unit from the apparatus comprises means 2 to align the rolls 3 along the axis 4 thereof and to move same in aligned condition, in parallel relationship with said axis, means 5 to change the movement direction of said rolls 3 and so arranged as to align same by gravity in such a way that the axes 5 thereof lie in parallel relationship and the rolls move at right angle to said axes, means 6 to locate one by one empty prefabricated boxes 7 in the path of said rolls as same move by gravity, at right angle to the axes thereof, means 8 to immobilize temporarily a box 7 during the filling thereof, means 9 controlled by a counting device (not shown), driven by the passage of the rolls through said means 5, to release by gravity a box filled with a predetermined number of rolls 3 and replace same by an empty box, and finally means 10 to discharge the filled box.

Said means 2 to align the rolls 3 along the axis 4 thereof and to move same in aligned condition and in parallel relationship with said axis, are comprised of an endless belt 11 continuously driven by a motor 12, belt on the upper side 13 of which the rolls 3 are dumped one by one through the outlet 1 from said machine. The lengthwise axis of side 13 is located in a horizontal plane and said side 13 lies at an angle to said plane, a guide 14 extending in parallel relationship with said lengthwise axis adjacent edge 15 from side 13, being provided on either side from the discharge station 16 for the rolls 3, in such a way that said rolls roll on side 13 to bear on said guide 14 and to be carried along said endless belt in the direction of arrow 17 and with the axes thereof in parallel relationship with the lengthwise axis of belt side 13, down to means 5. Said means 5 which allow to change the movement direction of the rolls 3 to have same moving at right angle to the lengthwise axis of said side 13, comprise a hopper 18 which extends at right angle to endless belt 11, on the same side as guide 14 and adjacent edge 15 from side 13. The hopper bottom 19 which is used as rolling way for the rolls 3 which move thereon by gravity, lies substantially in the same plane as the one which passes through the upper surface of belt side 13. The inlet 20 to the hopper lies at the end 21 from guide 14 in such a way that those rolls carried by belt 11 enter said hopper by gravity as soon as they are no more supported by guide 14. To force said rolls 3 to enter hopper 18 there is provided adjacent thereto a guide 20' extending at an angle relative to the lengthwise axis of side 13 and lying in the path of those rolls 3 carried by endless belt 11, the slanting of said guide relative to said lengthwise axis being a function of the roll length to let said rolls bear simultaneously on guide 20' and on the end 21 from guide 14 to enter correctly said hopper. The hopper outlet is comprised of an opening 22 provided in bottom 19, the sizes of inlet 20, bottom 19 and opening 22 of the hopper as considered in parallel relationship with the lengthwise axis of side 13, are substantially equal and slightly larger than the size of the rolls as considered in parallel relationship with the axis thereof. The size of opening 22 at right angle to said lengthwise axis is slightly larger than the roll diameter in such a way that rolls running down the hopper can come out by gravity therefrom through opening 22. The suitable running down of the rolls inside the hopper is obtained by means of guides 23 projecting at right angle from bottom 19, the drop of the rolls one by one through opening 22 being insured by a guide 24 extending cross-wise to guides 23 and 23'. Finally an accurate positioning of the rolls inside the hopper right from inlet 20 thereof, is obtained by means of a movable stop 25 which is so arranged as to lie in two end positions, a first position shown in FIGS. 1 to 3 in which said stop projects relative to hopper bottom 19 to stop each roll entering said hopper and position same with the lengthwise axis thereof in parallel relationship with the lengthwise axis of belt side 13 to let said roll roll to a suitable position to escape through opening 22, between guides 23, and a second position in which said stop is retracted below bottom 19 to release the roll. Said stop 25 extends in parallel relationship with belt side 13, on the one hand, at a distance from hopper inlet 20 which is slightly larger than the roll diameter and on the other hand, over a substantial portion of the hopper from hopper guide 23'. Means 26 are provided to move along a direction at right angle to bottom 19, said stop 25 between both end positions thereof. Said means 26 are comprised as shown in FIG. 2, of an electro-magnet 27 fastened underneath the hopper and the core 28 of which is fastened to stop 25, and a switch 29 the operating member 30 of which projects relative to bottom 19. Said switch 29 is arranged between hopper inlet 20 and stop 25, adjacent guide 23, at a distance which is substantially equal to half the spacing between said inlet 20 and stop 15. The circuit of switch 29 and electro-magnet 27 is so arranged as to have said electro-magnet 27 energized to retract stop 25 underneath bottom 19 each time a roll fed to the hopper, contacts with a generatrix thereof stop 25 and in this position, bears on operating member 30 of said switch. As soon as the stop has moved away, the roll bearing thereon runs down by gravity along bottom 19 towards opening 22 and relases said operating member 30 which cuts-off the energizing of electro-magnet 27, said stop then being returned to the first position thereof by springs 31, to intercept and correctly locate the following roll.

Said means 6 to locate one by one the empty prefabricated boxes 7 in the path of rolls 3 coming out of opening 22 from hopper 18, comprise an enclosure 32 the size of which corresponds to the size of the box in the opened condition thereof, bounded by a slanting plane 33 in parallel relationship with bottom 19 from hopper 18, by two fixed guides 34 and 34' at right angle to slanting plane 33 and in parallel relationship with the movement direction of the rolls inside hopper 18, and by a retractable stop 35 arranged between guides 34 and 34' to project in the one position thereof relative to slanting plane 33, at right angle thereto and to guides 34 and 34'. The slanting plane 33 lies at a lower lever than the bottom of hopper 18 and at a distance thereof which is slightly larger than the height of box 7, said guides 34 and stop 35 in the position where said stop 35 projects relative to the slanting plane, having also a height which is substantially equal to the box height. Said stop 35 lies at such a distance from opening 22 that an open box 7 inside the enclosure, that is a box the bottom of which bears on slanting plane 33, and three side walls thereof bear on guides 34 and 34' and stop 35, is arranged with the opening thereof facing opening 22 of hopper 18 to let those rolls passing through said openings fall by gravity into said box and come to lie automatically therein in superposed rows. A magazine 36 for prefabricated boxes is provided and arranged outside said enclosure 32 and communicates therewith. Said magazine 36 is arranged adjacent guide 34' and boxes 7 are stocked therein in folded condition and at right angle to slanting plane 33, and said magazine comprises means to cause boxes to pass one by one from said magazine into the enclosure while insuring the opening thereof during said transfer, means being provided moreover to operate stop 35 to retract same below slanting plane 33 to allow discharging by gravity from said enclosure, a box filled with a predetermined number of rolls 3. As shown in FIGS. 1 to 3, the magazine 36 is comprised of a support 37 for the boxes which extends in the extension of slanting plane 33, a fixed stop 38 which extends at right angle to said plane and a movable guide 39 which extends in parallel relationship with stop 38, is guided inside a groove 40 provided in support 37 and is biased by a counter-weight 41 towards stop 38 to compress the boxes 7 inside the magazine between said stop 38 and guide 39. The means provided to cause the boxes 7 to pass one at a time from magazine 36 into enclosure 32, comprise a space 42 bounded adjacent enclosure angle 43, by end 44 from guide 34' and by the side surface of a straight cylindrical body 45 which is partly housed underneath hopper bottom 19, said body 45 being rotatable about a shaft 46 with an axis at right angle to slanting plane 33, the spacing between said end 44 and the surface of said body 45 being substantially equal to the thickness of one box 7 in folded condition. The side 46 of stop 38 extends tangentially to the side surface of body 45 while the periphery thereof is slightly longer than the length of one box in folded condition to cause during a revolution of said body about the axis thereof, said body to transfer a box from magazine 36 into enclosure 32 and insure the automatic opening thereof during said transfer, said opening occuring by means of the motion imparted to said box by body 45, the guiding of the box inside space 42 as well as the position thereof, the angle of about 130° formed by stop 38 and guides 34 and 34', and due to the bearing of said box on said guides and stop 35 during the box transfer. The cylindrical body is driven by a motor 47 fastened to slanting plane 33, the motor circuit being so arranged that the energizing thereof be cut-off when body 45 has made a complete revolution, the energizing of motor 47 being controlled from said counting device operated by switch 29, said switch being so adjusted as to trigger said energizing when the predetermined number of rolls contained inside a box is reached, a time delay being provided in the circuit and so adjusted as to let the last coin roll driving said operating member 30 from switch 29 traverse the hopper and fall into the box through opening 22. Said means provided to retract stop 35 below the level of slanting plane 33, to allow discharging a roll-filled box, are comprised of an electro-magnet 48, fastened below slanting plane 33 and the core of which is associated with said stop. The circuit of electro-magnet 48 is so arranged as to energize same as in the case of motor 47, from said counting device controlled by switch 29, to retract stop 35, said time-delay provided in the circuit of motor 47, being such that the motor will only be supplied at the moment where the stop 35 has been retracted below said slanting plane and the box which has just been filled with rolls, will already have started the lowering movement thereof by gravity over slanting plane 33. Cylindrical body 45 has over part of the circumference thereof, a layer of anti-skid material 49 which projects and the development of which is substantially equal to the length of a box 7 in folded condition. It will be noted in FIG. 3 that said material layer is so arranged over body 45 that during a complete revolution thereof, a box in folded condition is arranged inside enclosure 32 and the following box is already partly removed from magazine 36 to have the end 50 thereof enter that space 42 remaining between end 44 of guide 34' and that portion 51 of cylindrical body 45 devoid of anti-skid material, said following box thus remaining in readiness until a further rotating of body 45 to feed the box inside enclosure 32.

The means 10 for discharging the filled boxes one at a time, are comprised of an extension 52 of slanting plane 33 and guides 34 and 34', and of a second endless belt 53 continuously driven by a motor 53', the upper belt side 54 being horizontal and arranged at the bottom of slanting plane 52.

Even if in FIGS. 1 to 3, but one unit has been shown, the apparatus according to the invention may comprise with a parallel arrangement, a plurality of units with hopper 18, enclosure 32, magazine 36 and those means associated therewith, each such unit operating on rolls with the same or different sizes, said units being located between endless belts 11 and 53 and a number of machines delivering coin rolls equal to the number of said units, being provided to deliver said rolls on belt 11 upstream of hopper 18 from the corresponding unit. Such an apparatus will then comprise means provided on slanting plane 52, inside each one of the units located upstream of the first unit when considering the movement direction of belt 53 as shown by arrow 68, to retain a full box on the slanting plane in the case where the feeding thereof towards belt 53 would hinder the passage of another box moving over belt 53. Said means are comprised as shown in FIGS. 1 to 3, of a retractable stop 69 located between guides 34 and 34', said stop being controlled as well as stops 28 and 35, by an electro-magnet 70 to project relative to slanting plane 52 for stopping a box running down said plane. Said electro-magnet is controlled to cause the stop 69 to project relative to slanting plane 52, either by photo-electric cells not shown, which are arranged adjacent belt 53 to sense the presence of a filled box on that portion of belt 53 which corresponds to the transfer area of the boxes from slanting plane 52 to belt 53, or by arranging the apparatus circuitry to energize the electro-magnet 70 from one unit for causing stop 69 to project relative to slanting plane 52 when within a predetermined time delay, the electro-magnets 48 from those units located upstream of the unit under consideration when considering the movement direction of endless belt 53 have been energized to retract stops 35.

It would further be possible according to the invention, to provide means to monitor the passage of the coin rolls through hopper 18 and means to monitor the filling of the box, arranged adjacent enclosure 32.

As some machines forming coin rolls are so arranged as to make rolls having different sizes by substituting some parts thereof, the invention has also for object to provided an apparatus for boxing automatically rolls which comprises a single unit the position of some components of which can be changed simply and easily to be fitted to that kind of roll produced by the machine. Said apparatus is of particular importance for users having but one machine forming different-sized rolls.

Figure 4:
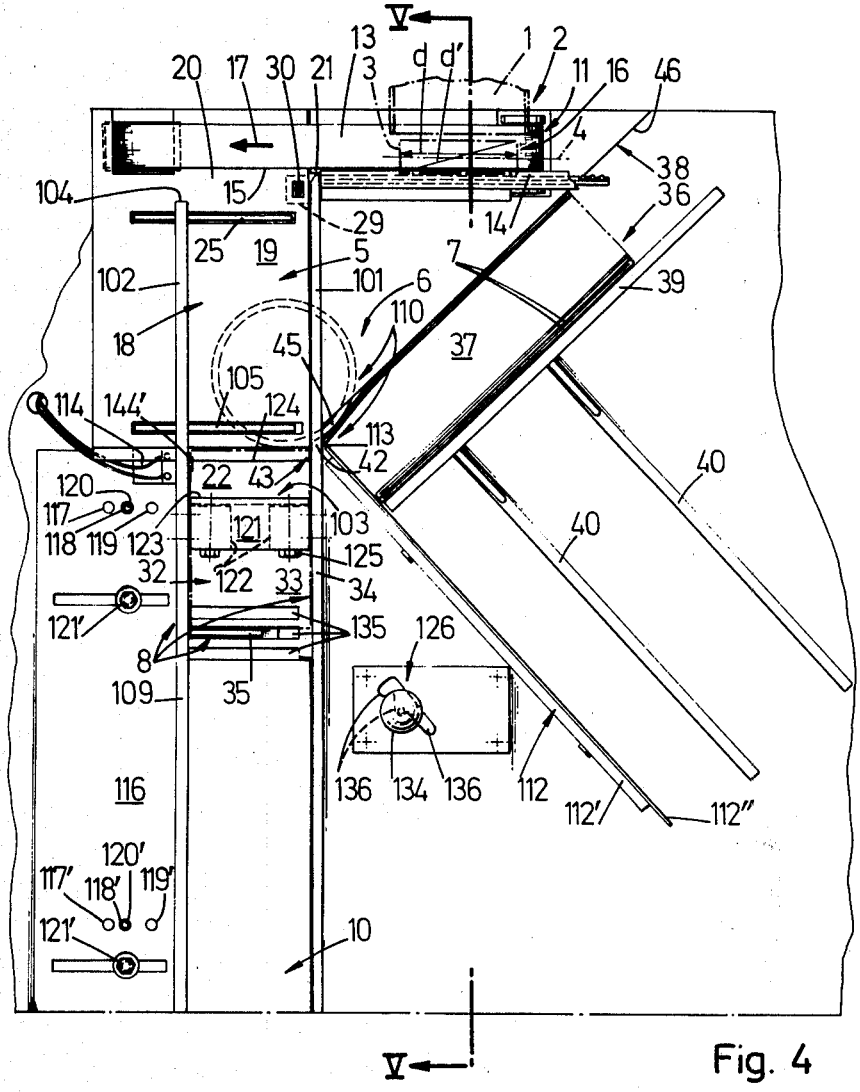
FIG. 4 is a diagrammatic view with parts broken away along line IV—IV in FIG. 5, of a variation of the apparatus shown in FIGS. 1 to 3.
Figure 5:
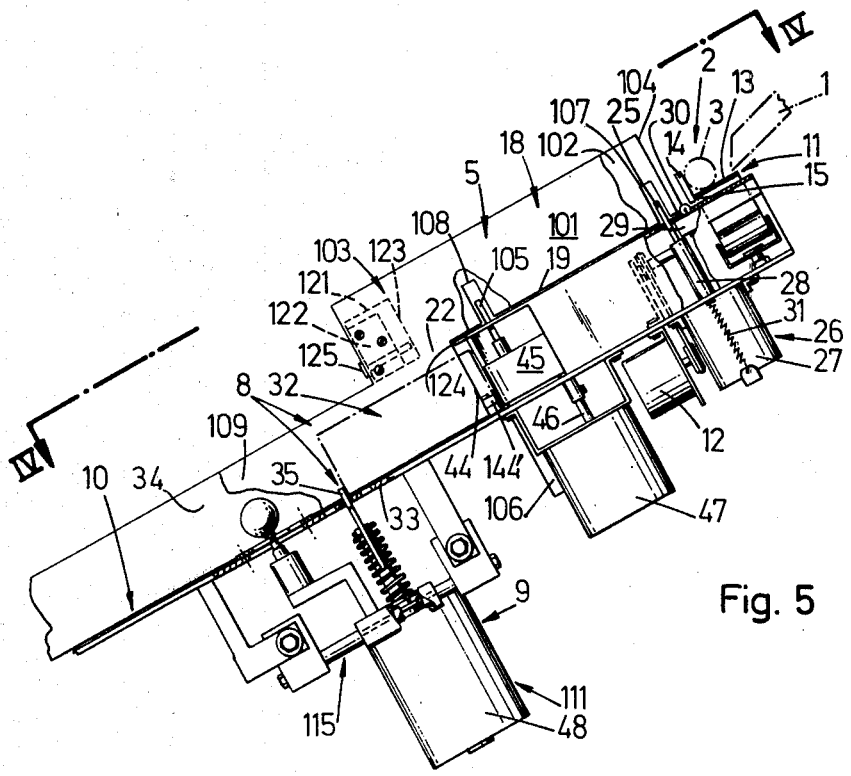
FIG. 5 is a view with parts broken away, along line V—V in FIG. 4.
Figure 6:
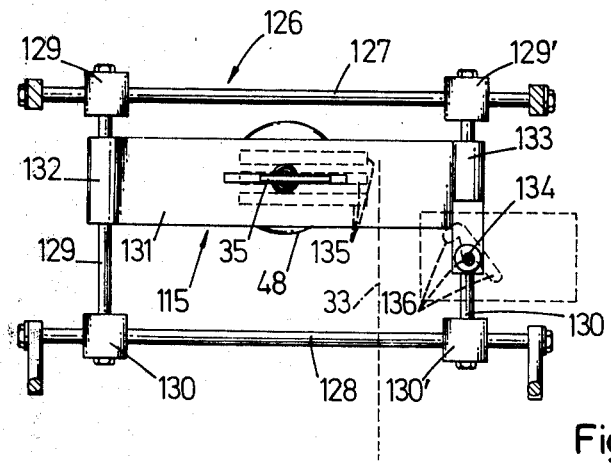
FIG. 6 is a plan view showing a detail from the apparatus shown in FIGS. 4 and 5.

The apparatus according to the invention and shown in FIGS. 4 to 6 is to be fed by a known machine for forming coin rolls and the outlet 1 of which is shown dashed in FIGS. 4 and 5. For boxing automatically coil rolls of the same size, the apparatus comprises means 2 to align said rolls 3 along the axis 4 thereof and to move same in aligned condition in parallel relationship with said axis, means 5 to change the movement direction of said rolls 3 and so arranged as to align same by gravity in such a way that the axes 4 thereof be parallel and the rolls 3 move at right angle to said axes, means 6 to arrange one by one empty prefabricated boxes in the path of said rolls as they move by gravity at right angle to the axes thereof, means 8 to immobilize temporarily a box 7 during the filling thereof and means 9 controlled by a counting device (not shown) operated by the passage of said rolls 3 through means 5, to release by gravity a box filled with a predetermined number of rolls 3 and replace same by an empty box, and means 10 to discharge the filled box.

Said means 2 to align the rolls 3 along the axes 4 thereof and to move same in aligned condition in parallel relationship with said axes 4, are comprised of an endless belt 11 driven continuously by a motor 12, on the upper side 13 of which the rolls 3 are discharged one at a time from outlet 1 of said machine. The lengthwise axis of belt side 13 lies in a horizontal plane and said side 13 makes an angle relative to said plane, a guide 14 provided with a needle race reducing the friction of rolls 3, extending in parallel relationship with said lengthwise axis adjacent edge 15 from side 13 and being provided on either side of the discharge station 16 for the rolls 3, in such a way that said rolls roll over belt side 13 to bear on the race from guide 14 and to be driven by said endless belt in the direction of arrow 17, and with the axes thereof aligned in parallel relationship with the lengthwise axis of belt side 13, down to means 5. Said means 5 allowing to change the movement direction of rolls 3 to cause same to move at right angle to the lengthwise axis of side 13, comprise a hopper 18 which extends at right angle to endless belt 11 on the same side as guide 14 and adjacent edge 15 of belt side 13. The bottom 19 of said hopper which is used as rolling way for the rolls 3 which move thereon by gravity, lies substantially in the same plane that passes through the upper surface of belt side 13. The inlet 20 to the hopper is located at the end 21 of guide 14 in such a way that the rolls carried by belt 11 enter said hopper by gravity when they are no more supported by guide 14. The hopper outlet is comprised of an opening 22 provided in bottom 19 at a lower level than inlet 20, in such a way that the lengthwise axis thereof lies in parallel relationship with the movement direction of belt side 13. Said hopper is bounded along those sides of bottom 19 extending at right angle to side 13 and along that edge of opening 22 in parallel relationship with side 13 and lying at the lowermost level, by three guides 101, 102 and 103 which extend at right angle to bottom 19 above the level thereof. Guide 101 at right angle to belt side 13 is fixed and extends from end 21 of guide 14 to the edge of opening 22 lying at the lowermost level. Guide 102 in parallel relationship with guide 101, is movable in parallel relationship with itself to adapt the spacing between guides 101 and 102 to the dimension d of the rolls as considered in parallel relationship with the axis 4 thereof. Said spacing is larger than roll dimension d and smaller than a diagonal d' from the projection of a roll on a plane in parallel relationship with the axis 4 thereof, in such a way that the axis of the rolls moving over the hopper bottom remains substantially in parallel relationship with belt side 13 to prevent any jamming of the rolls inside the hopper. The end 104 of guide 102 lies as defined hereinafter, at a distance from edge 15 of belt side 13 and extends down to the edge of opening 22 lying at the lowermost level. Guide 103 is movable in parallel relationship with side 13 to limit said edge of opening 22 lying at the lowermost level according to the diameter of coin rolls 3, the spacing between that surface of guide 103 facing inwards and the edge of opening 22 in parallel relationship therewith, being larger than the roll diameter, in such a way that said rolls running down the hopper can escape by gravity therefrom through opening 22. The suitable running down of the rolls inside the hopper is insured due to the spacing between guides 101 and 102 and the suitable positioning of the rolls inside said hopper right from the inlet 20 thereof, is obtained by means of a movable stop 25 which is so arranged as to lie in two end positions, the one position shown in FIG. 5 in which it projects relative to hopper bottom 19, to stop each roll entering said hopper and arrange same in such a way that the axis thereof lies in parallel relationship with the lengthwise axis of belt side 13 to let the roll 3 roll to a suitable position between guides 101 and 102, and a second position in which said stop is retracted below bottom 19 to release the roll. Said stop 25 extends in parallel relationship with belt side 13, on the one hand at a distance from hopper inlet 20 which is slightly larger than the maximum diameter of those coin rolls 3 which can be boxed by the apparatus and on the other hand, over a substantial portion of the hopper from movable guide 102. Means 26 are provided to move along a direction at right angle to bottom 19 said stop 25 between both end positions thereof. Said means 26 are comprised as shown in FIG. 5, of an electro-magnet 27 fastened underneath said hopper and the core 28 of which is fastened to stop 25, and of a switch 29 the operating member 30 of which projects relative to bottom 19. Said operating member 30 is arranged between hopper inlet 20 and stop 25, adjacent to fixed guide 101 and at such a distance from said stop that a roll the diameter of which is comprised between the largest and smallest diameters of those rolls which can be boxed by the apparatus, bearing on stop 25 will bear on operating member 30. The circuit of switch 29 and electromagnet 27 is so arranged as to energize said electro-magnet to retract stop 25 below bottom 19 every time a roll fed to the hopper contacts with a generatrix thereof said stop 25 and in this position, bears on operating member 30 of switch 29. As soon as the stop is retracted, the roll bearing thereon runs down by gravity into the hopper, and releases the operating member 30 of switch 29 which cuts-off electro-magnet 27, said stop 25 then being returned to the first end position thereof by spring 31, to retain and correctly position the following roll.

To let the rolls enter the hopper when said rolls take a slanting position relative to side 13 when they are no more completely supported by guide 14, the end 104 of guide 102 is located at a distance from stop 25 which is shorter than the smallest radius of those coin rolls which can be boxed by the apparatus, in such a way that the roll bottom can bear on guide end 104 and swing about said end to bear on stop 25.

A second movable stop 105 similar to stop 25 is arranged inside the hopper in parallel relationship with said stop 25 and at a lower level than said stop 25. The spacing between stop 25 and stop 105 corresponds to a multiple of the largest diameter of those rolls which can be boxed by the apparatus, said multiple being lower than or equal to the number of rolls to be fitted inside every box. Said stop 105 is controlled as it is the case with stop 25, by an electro-magnet 106 the circuit of which is so designed that the electro-magnet is energized to retract stop 105 below the hopper bottom, by means of a counting device not shown, for a predetermined number of goods, said counting device being pulsed by said switch 29. As in the case of stop 25, the stop 105 extends from guide 102 over a substantial portion of said hopper, openings 107 and 108 being provided in said guide 102 to let through said stops 25 and 105 to let same extend on either side of movable guide 102 in such a way that when said guide 102 is farthest removed from fixed guide 101, said stops 25 and 105 close-off said openings 107 and 108. The purpose of stop 105 is double. First of all said stop enables receiving and retaining inside the hopper coin rolls 3 during the discharge of a filled box and the positioning of a fresh empty box, and also insuring a better positioning of the rolls inside the box. Indeed said rolls are better arranged inside the box when at least part of those rolls comprising the first roll row inside the box, are dumped as a layer inside said box through hopper opening 22.

Said means 6 to locate one at a time the empty prefabricated boxes in the path of rolls 3 coming out of opening 22 of hopper 18, comprise an enclosure 32 the size of which correspond to the size of the open box which is to receive at least one roll row in parallel relationship with the lengthwise axis of said belt side 13, bounded by a slanting plane 33 in parallel relationship with hopper bottom 19 and lying at a lower level than said bottom 19 at a distance therefrom which is at least slightly larger than the box height, a fixed guide 34 at right angle to slanting plane 33 and in parallel relationship with the movement direction of the goods inside the hopper, a movable guide 109 the position of which is adjustable according to dimension d of said rolls and the corresponding dimension of the boxes, in parallel relationship with guide 34, and a retractable stop 35 arranged between guides 34 and 109 and projecting relative to slanting plane 33 at right angle thereto and to said guides. The position of stop 35 is adjustable, said stop being so arranged as to be movable in parallel relationship with itself according to the dimension of the boxes as considered in parallel relationship with the movement direction of rolls 3 inside hopper 18 and in such a way that said stop engages movable guide 109 whatever the position thereof, to cooperate with the means insuring the automatic opening of boxes 7. Means 126 are provided to move said stop 35 to adjust the position thereof with such a spacing from hopper opening 22 that a formed box lying inside enclosure 32 with the bottom thereof lying on slanting plane 33 and with three side walls thereof bearing on guides 34 and 109 and on stop 35, will have the opening thereof in that box zone lying at the topmost level, facing hopper opening 22 to let the rolls passing through said opening fall into said box and fit therein by gravity. Said means 6 further comprise a magazine 36 for prefabricated boxes 7 which is arranged outside enclosure 32 and communicates therewith. Said magazine 36 is arranged adjacent fixed gide 34 and so designed that said boxes 7 be stocked in folded condition and in such a way that those portions comprising the box side walls be arranged at right angle to slanting plane 33, means 110 being provided to cause the boxes to pass one at a time from magazine 36 inside enclosure 32 while insuring the opening thereof during the transfer, as well as means 111 to operate retractable stop 35 to retract same underneath slanting plane 33 to let a filled box leave enclosure 32 by gravity. Said magazine 36 is comprised of a holder 37 for the boxes extending in the extension of slanting plane 33, a fixed stop 38 extending at right angle to said plane and against which the boxes 7 come to bear, a fixed guide 112 extending at right angle to stop 38 and against which the boxes 7 are aligned, and a movable guide 39 extending in parallel relationship with stop 38, said stop 38 and guides 39 and 112 being arranged above holder 37. Said movable guide 39 is guided in parallel grooves 40 provided in holder 37, and biased towards stop 38 by a counterweight to cause the boxes 7 to be compressed inside magazine 36 between said stop 38 and guide 39.

The means 110 provided to cause the boxes 7 to pass one at a time from magazine 36 into enclosure 32 comprise a space 42 bounded adjacent the angle 43 of said enclosure, by the end 113 of fixed guide 112 of the magazine, and by the side surface of a straight cylindrical body 45, partly received underneath hopper bottom 19, said body being rotatable about a shaft 46 with an axis at right angle to slanting plane 33, the spacing between ends 44 and 113 of guides 34 and 112 and said side surface being slightly larger than the thickness of a box 7 in folded condition. The face 46 of fixed stop 38 extends substantially tangentially to the side surface of body 45 and that plane passing through said face 46 intersects movable guide 109 of enclosure 32 at a slightly higher level than the intersection of said movable guide 109 and retractable stop 35 when said stop 35 lies in the position thereof nearest hopper opening 22. The cylindrical body 45 is rotated by a motor 47 fastened to slanting plane 33, the motor circuit being so designed that the energizing and cutting-out thereof be controlled by a switch 114 the operating member 114' of which lies inside enclosure 32 and fastened to movable guide 109 underneath hopper opening 22 in such a way that said switch is operated by the corresponding side wall of that box entering the enclosure at the moment where said box is formed, the presence of a box causing the motor to be cut-off while the absence of a box causes the energizing of said motor. The fixed guide 112 of the magazine is advantageously made in two parts, a fixed part 112' and a part 112'' the position of which is adjustable relative to part 112' to allow adjusting accurately the spacing between that end of part 112'' nearest the cylindrical body 45 and the side surface thereof according to the thickness of said boxes 7 in folded condition in such a way that but one box can enter the space lying between said end of part 112'' and the side surface of cylindrical body 45.

The means 111 to retract stop 35 below slanting plane 33 to allow discharging a filled box from the enclosure, are comprised of an electro-magnet 48 fastened to a device 115 described hereinafter, the core of which is associated with the stop. The electro-magnet circuit is so designed that the electro-magnet will be energized from said counting device to retract said stop. A time delay is provided in the circuit of the electro-magnet controlling said stop 35, said delay being so adjusted as to let the last coin roll acting on operating member 30 of switch 29 travel through the hopper and fall into the box.

To allow adjusting simultaneously the position of guides 102 and 109 according to dimension d of the rolls, said guides which lie in the extension of one another, advantageously form a single part. Said part has opposite enclosure 32, a flange 116 which bears on an extension of slanting plane 33, said flange having two parallel rows of openings 117, 118 and 119, and 117', 118' and 119' aligned in parallel relationship with the lengthwise axis of belt side 13. Each opening row cooperates with a lug 120 or 120' fastened to slanting plane 33. The spacings between corresponding openings in the rows on said part forming the guides 102 and 109 are equal and a function of three particular dimensions d of the coin rolls to be boxed. The flange 116 is retained in the selected position by nuts 121' cooperating with screws fastened to said slanting plane.

The guide 103 arranged inside the hopper is comprised of a removable bracket 121 mounted on two blocks 122 fastened to guides 101 and 102, the size of the bracket used as considered in parallel relationship with said guides, is a function of the roll diameter and is such that the spacing between bracket surface 123 and edge 124 of opening 22 is slightly larger than the roll diameter. The bracket is fastened to blocks 122 by screws 125.

To allow some arrangement freedom for the coin rolls inside the box along the roll movement direction inside the hopper, the hopper bottom advantageously overhangs enclosure 32 over a distance considered in parallel relationship with said direction, which is shorter than the largest radius of the coin rolls to be boxed.

The means 126 to move in parallel relationship with itself said retractable stop 35 are comprised as shown more particularly in FIG. 3, of two fixed shafts 127 and 128 in parallel relationship with one another, with stop 35 and with slanting plane 33, two parallel shafts 129 and 130 at right angle to shafts 127 and 128 on either side of stop 35 and each bearing at both ends thereof, pedestals with straight bearings 129, 130 and 129', 130' which are slidable on said shafts 127 and 128 along a direction in parallel relationship therewith. Said device 115 comprises a bearing plate 131 for electro-magnet 48, which plate 131 extends between both said shafts 127 and 128 and is provided at both ends thereof with pedestals 132 and 133 fitted with straight bearings cooperating with said shafts 129 and 130 to let plate 131 slide along a direction in parallel relationship with said shafts. A control lever 134 is mounted on pedestal 133, the bottom 33 of enclosure 32 being provided with parallel openings 135 shown dotted in FIG. 3, to let through said stop 35, the number of said openings corresponding to the number of openings provided in each opening row in said flange and the location thereof corresponding to the box size as considered at right angle to belt side 13, said boxes containing coin rolls with a length and a diameter which are determined respectively by the position of that part formed by the movable guides of the hopper and the enclosure, and by the size of hopper opening 22 as considered in parallel relationship with the roll movement direction inside said hopper. Notches 136 are provided in the slanting plane to locate said lever 134 in predetermined positions and the number of said notches corresponds to the number of openings 135, each position corresponding to a determined length and diameter for the coin rolls, a switch (not shown) being provided to energize and hold energized the electromagnet controlling said stop 35 to retract same below slanting plane while the position of said stop 35 is changed.

Figure 7:
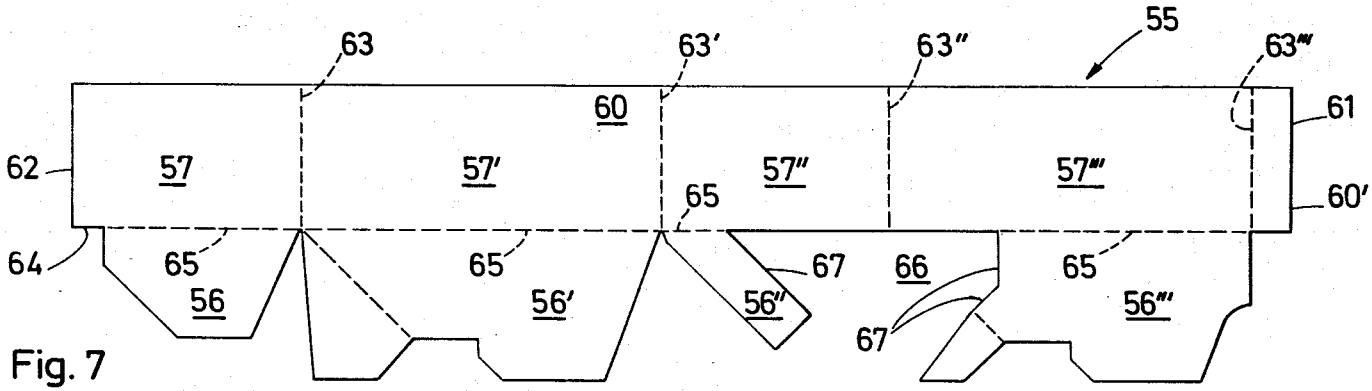
FIG. 7 is a plan view of the box blank according to the invention.
Figure 9:
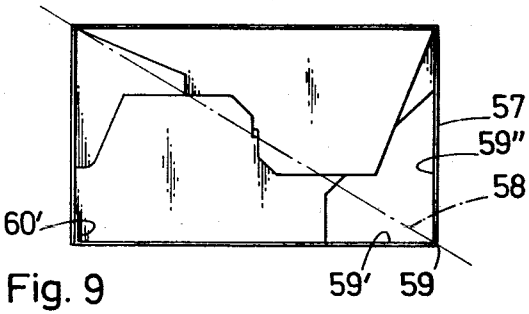
FIG. 9 is a plan view of the box in open condition.
Figure 8:
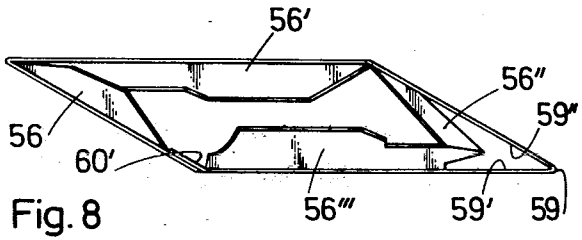
FIG. 8 is a plan view of the box, with said box in partly-folded condition.

The box according to the invention as shown in FIGS. 7 to 9 is a box with rectangular bottom the blank 55 of which is so cut-out as to let the box be folded in such a way that those components 56, 56', 56'' and 56''' comprising the bottom be foldable over the side walls 57, 57', 57'' and 57''' inside same when the side walls are brought together two by two, that is the walls 57–57' and 57''–57''', relative to a plane at right angle to the bottom and passing through a diagonal 58 thereof. Those components comprising the bottom are so cut-out that when the box lies in folded condition, both side walls 57'' and 57''' joined along an edge 59 lying in that plane passing through said diagonal can contact one another directly in the zones 59' and 59'' thereof adjacent said edge 59.

The blank 55 the box is formed from comprises a rectangular strip 60 with a constant width, which is to form the box side walls and is comprised of five quadrilaterals 57 to 57''' and 60' bounded by the ends 61 and 62 of said strip and by four folding lines 63 to 63''' in parallel relationship with said ends 61 and 62, bounding suceedingly the four side walls of the box, that quadrilateral 60' lying at end 61 of the strip, being intended to be folded back and glued on quadrilateral 57 lying at the other end 62 of the strip. The blank further comprises four components 56 to 56''' which are to comprise the box bottom and are cut-out in a way known per se, said components being distributed along strip edge 64 with folding lines 65 following said edge in such a way as to lie each facing one of those four quadrilaterals which will form the box side walls, the adjoining components 56'' and 56''' lying on either side of folding line 63'' which will form edge 59, having a cut-out 66 bounded in each such elements 56'' and 56''' and from folding line 63'', by strip edge 64 and a segment 67 of a slanting line extending away from the strip, towards the extension of folding line 63'' and ending at such a distance therefrom that bottom components 56'' and 56''' will not be pinched between side walls 57'' and 57''' folded back adjacent folding line 63'' corresponding to said edge 59. Said cut-out 66 is provided to let the box bottom free to unfold during the feeding of the box into enclosure 32 of the apparatus according to the invention while the box is still pinched adjacent edge 59 thereof, between either end 44 of guide 34' or end 113 of guide 112, and cylindrical body 45.

It must be understood that the invention is in no way limited to the above embodiments and that many changes can be brought therein without departing from the scope of the invention as defined in the appended claims.

We claim:

1. Apparatus for automatically boxing cylindrical goods, particularly a plurality of uniformly-dimensioned cylindrical rolls of coins fed by at least one machine producing such cylindrical goods, which apparatus comprises:

means to longitudinally align a plurality of individuals of said goods and to move them in said aligned condition in parallel with said axis;

means to change the movement direction of said goods and to align a plurality of them by gravity with the longitudinal axes thereof in parallel relationship and to move said goods at a right angle to said axes;

means to arrange one-by-one a plurality of empty prefabricated boxes on the goods path as said goods move by gravity at a right angle to the axes thereof;

means to immobilize, temporarily, each said box during the filling thereof;

means controlled by a counting mechanism driven by the passage of said goods, and so arranged as to release by gravity each respective, resultingly filled box and to operate said arranging and temporarily immobilizing means to replace the respective resultingly filled box by an empty box;

means to discharge the filled box;

said means for aligning the goods along the axis thereof and for moving same in aligned condition in parallel relationship therewith being comprised of an endless belt driven with a continuous motion, on the top side of which individuals of the goods from said machine are dumped one at a time, the lengthwise axis of said belt side lying in a horizontal plane and the belt side making an angle therewith, and a guide extending in parallel relationship with said lengthwise axis of the belt side adjacent the belt side edge lying underneath said horizontal plane, said guide projecting over a distance at least equal to the radius of said individuals of said goods, relative to the belt side and extending on either side of that location where the goods are dumped.

2. Apparatus as defined in claim 1, in which said means to change the movement direction of said goods comprise a hopper which extends at right angle to said top belt side on the same side as said guide adjacent said belt side, the hopper bottom used as rolling way for the goods which move thereon by gravity, lying substantially in the same plane as that plane passing through the top surface of said belt side, the hopper inlet lying at that guide end lying as considered along the movement direction of said belt side, upstream of that location where said goods are dumped on said side of the endless belt, the hopper outlet lying at a lower level than the hopper inlet, being comprised of an opening provided in the hopper bottom, the lengthwise axis of said opening lying in parallel relationship to the movement direction of said belt side, the dimensions of the hopper inlet, bottom and opening as considered in parallel relationship with said latter direction, being slightly larger than the dimension of the goods as considered in parallel relationship with the axis thereof, the opening size as considered at right angle to the movement direction of said belt side, being slightly larger than the diameter of said goods, the hopper being bounded along those bottom sides thereof extending at right angle to said belt side and along that opening edge in parallel relationship with said belt side at the lowermost level, by guides at right angle to said hopper bottom above the level thereof, a guide which extends cross-wise to said top belt side to lie in the path of the goods carried by said belt side, being further provided to force said goods to enter the hopper.

3. Apparatus as defined in claim 2, in which the means to arrange one at a time empty prefabricated boxes in the path of the goods as they move by gravity at right angle to the axes thereof, comprise an enclosure the size of which corresponds to the box size, bounded by a slanting plane in parallel relationship with the hopper bottom, two fixed guides at right angle to said slanting plane and in parallel relationship with the movement direction of said goods inside the hopper, and a retractable stop arranged between both said guides and projecting relative to said slanting plane at right angle thereto and to said guides, said slanting plane lying at a lower level than the hopper bottom and at a distance therefrom at least slightly larger than the box height, the height of said guides and retractable stop also being substantially equal to the box height, said retractable stop lying at such a distance from the opening provided in the hopper that a formed box arranged within said enclosure, with the bottom thereof bearing on the slanting plane and three side walls thereof bearing on said guides and retractable stop, has the opening thereof in that box zone lying at the uppermost level, facing the hopper opening in such a way that goods passing through said latter opening fall by gravity into said box, said means further comprising a prefabricated box magazine arranged outside said enclosure and communicating therewith, said magazine being arranged adjacent the one said guides and being so designed that the boxes be stocked in folded condition and in such a way that those components comprising the side walls of the boxes lie substantially at right angle to said slanting plane, means being provided to cause the boxes to pass one at a time from the magazine inside said enclosure and so arranged as to insure forming thereof during the transfer, as well as means to operate said retractable stop to retract same below the slanting plane to allow discharging a filled box by gravity.

4. Apparatus as defined in claim 2, which further comprises a movable stop so arranged inside the hopper as to lie in two end positions, the one position where said stop projects relative to the hopper bottom to stop an object moving by gravity therein, and a second position in which said stop is retracted to a lower level than said bottom, to release said object, said stop extending in parallel relationship with said belt side, at a distance from the hopper inlet which is slightly larger than the diameter of the goods, and means to move along a direction substantially at right angle to the hopper bottom, the stop between both said end positions thereof.

5. Apparatus as defined in claim 4, in which said movable stop extends cross-wise to the movement direction of said goods, over a substantial portion of said hopper from the hopper guide at right angle to said belt side and farthest away from that location where the goods are dumped on said endless belt.

6. Apparatus as defined in claim 4, in which said means for moving the movable stop are comprised of an electro-magnet fastened underneath the hopper and the core of which is associated with the stop, and a switch the operating member of which projects relative to the hopper bottom, said switch being arranged between the hopper inlet and the movable stop, adjacent the hopper guide at right angle to said belt side which is nearest that location where the goods are dumped on the endless belt, at a distance which is substantially equal to half the spacing between the hopper inlet and the movable stop, the circuit of the switch and electro-magnet being moreover so arranged as to energize said electro-magnet to bring said stop to said second position when an object fed to the hopper contacts with a generatrix thereof said movable stop and bears on the operating member of said switch.

7. Apparatus as defined in claim 3, in which the means to cause the boxes to pass one at a time from the magazine into said enclosure, comprise a space bounded adjacent the one enclosure angle, by the end of that enclosure guide comprising a magazine component and lying at the uppermost level, and by the side surface of a straight cylindrical body rotatable about a shaft with an axis at right angle to said slanting plane, the spacing between said end and said side surface being substantially equal to the thickness of a box in folded condition, the face of said fixed stop of the magazine extending substantially tangentially to said side surface, the cylindrical body circumference being at least equal to the box length in folded condition in such a way that a revolution of said cylindrical body about the axis thereof causes a box to pass from the magazine into the enclosure, that angle formed by the fixed stop face the boxes bear on and the enclosure guide face facing the magazine being larger than 90° and smaller than 180° according to the box size.

8. Apparatus as defined in claim 7, which further comprises a motor for rotating said cylindrical body, the motor circuit being so arranged that the supply thereto be cut-out when said cylindrical body has made a complete revolution about the axis thereof, the motor energizing being controlled from said counting device operated by said switch and so adjusted as to trigger said energizing when the predetermined number of goods contained inside a box has run down said hopper.

9. Apparatus as defined in claim 8, in which the means to retract the retractable stop from the enclosure to allow discharging a filled box, are comprised of an electro-magnet fastened underneath said slanting plane and the core of which is associated with said stop, the electro-magnet circuit being so arranged that said electromagnet be energized as said motor from said counting device, to retract said stop, the circuit of that motor driving said cylindrical body having such a time delay that the motor will not be energized before that moment where the stop has been retracted and the box will have started to go down on said slanting plane.

10. Apparatus as defined in claim 7, in which said cylindrical body has on part of the circumference thereof, a layer of anti-skid material projecting on said body, said material layer having an extension substantially equal to a box length in folded condition.

11. Apparatus as defined in claim 3, in which the means to discharge the filled boxes are comprised of an extension of said slanting plane and guides comprising said enclosure and extending away from said hopper, and an endless belt to be driven continuously, the top side thereof being horizontal and arranged at the bottom of said slanting plane.

12. Apparatus as defined in claim 11, which further comprises in parallel relationship a plurality of units formed by a hopper, an enclosure and a magazine and said means associated therewith, said units being arranged between both said endless belts and a number of machines being provided which is equal to the number of said units, each machine dumping the goods on the top endless belt upstream of the hopper in the considered unit, means being provided on said slanting plane and between the enclosure and lower endless belt in each unit, downstream of the first unit as considered along the movement direction of said lower endless belt, to retain a filled box on the slanting plane in that case where the movement thereof towards the lower endless belt would hamper the movement of another box moving thereon.

13. Apparatus as defined in claim 12, in which the means provided on said slanting plane are comprised of a retractable stop received between both said guides, said stop being controlled by an electro-magnet to project relative to said slanting plane to stop a box running down thereon, the circuity of the apparatus being so designed that said electro-magnet be energized to have the stop project relative to the slanting plane when during a predetermined time delay, those electro-magnets driving the retractable stops for discharging filled boxes from said enclosures in those units lying upstream of the considered unit along the movement direction of the endless belt for discharging said filled boxes, have been energized to retract said retractable stops.

14. Apparatus as defined in claim 3, in which said magazine is comprised of a holder for said boxes that surface of which said boxes bear on, lies in the same plane as the top surface of said slanting plane, the one fixed guide of the enclosure, a fixed stop extending at right angle to said plane and a movable guide extending in parallel relationship with said fixed stop, said guides and stop lying above said plane and extending crosswise to the guide of said enclosure, means being provided to bias said movable guide towards the fixed stop.

15. Apparatus for automatically boxing cylindrical goods, particularly a plurality of uniformly-dimensioned cylindrical rolls of coins fed by at least one machine producing such cylindrical goods, which apparatus comprises:

means to longitudinally align a plurality of individuals of said goods and to move them in said aligned condition, in parallel with said axis;

means to change the movement direction of said goods and to align a plurality of them by gravity with the longitudinal axes thereof in parallel relationship and to move said goods at a right angle to said axes;

means to arrange one-by-one a plurality of empty prefabricated boxes on the goods path as said goods move by gravity at a right angle to the axes thereof;

means to immobilize, temporarily, each said box during the filling thereof;

means controlled by a counting mechanism driven by the passage of said goods, and so arranged as to release by gravity each respective, resultingly filled box and to operate said arranging and temporarily immobilizing means to replace the respective resultingly filled box by an empty box;

means to discharge the filled box;

said means to change the movement direction of the goods and to align same by gravity in such a way that the axes thereof lie in parallel relationship being adjustable according to the size of said goods as considered in parallel relationship with the axis thereof, said means for immobilizing temporarily a box also being adjustable to receive one-by-one boxes size of which vary according to said dimension and diameter of the goods.

16. Apparatus as defined in claim 15, in which said means to change the movement direction of the goods comprise a hopper extending at right angle to said top side of the endless belt, on the same side as said guide and adjacent to said belt side, the hopper bottom used as rolling way for the goods moving thereon by gravity, lying substantially in the same plane as the plane passing through the top surface of said belt side, the hopper inlet lying at that guide end located when considering the movement direction of said belt side, upstream of that location where the goods are dumped on said side of the endless belt, the hopper outlet lying at a lower level than the hopper inlet, being comprised of an opening provided in said hopper bottom with the lengthwise axis thereof in parallel relationship with the movement direction of said belt side, said hopper being bounded along those bottom sides thereof extending at right angle to said belt side and along that opening edge in parallel relationship with said belt side lying at the lowermost level, by three guides extending at right angle to the hopper bottom above the level thereof, a first fixed guide at right angle to said belt side and extending from said guide end cooperating with said belt side at least down to that opening edge lying at the lowermost level, a second movable guide in parallel relationship with said first guide and so arranged as to be movable in parallel relationship with itself to adapt the spacing between said first and second guides according to the dimension of said goods as considered in parallel relationship with the axis thereof, said spacing being larger than said dimension and smaller than a diagonal of the projection of the goods on a plane in parallel relationship with the axis thereof, said second guide having the end thereof nearest said belt side lying at a distance from the edge of said belt side which lies below said horizontal plane and extending at least down to that opening edge lying at the lowermost level, and a third guide extending between said first and second guides, said third guide being movable in parallel relationship with said belt side to bound said opening edge lying at the lowermost level according to the diameter of said goods, the spacing between said third guide and that opening edge in parallel relationship therewith being larger than the diameter of said goods.

17. Apparatus as defined in claim 16, in which the means for arranging empty prefabricated boxes in the path of the goods as they move by gravity at right angle to the axes thereof, comprise an enclosure the size of which corresponds to the size of that open box provided to receive at least one row of goods lying in parallel relationship with the lengthwise axis of said belt side, bounded by a slanting plane in parallel relationship with the hopper bottom and lying at a lower level than said bottom at a distance therefrom at least slightly larger than the box height, a first fixed guide at right angle to said slanting plane and in parallel relationship with the movement direction of the goods inside the hopper, a second movable guide the position of which is adjustable according to the dimension of the goods as considered in parallel relationship with the axis thereof and the corrresponding box dimension, said second stop lying in parallel relationship with said first fixed guide, and a retractable stop arranged between both guides and projecting relative to said slanting plane at right angle thereto and to said guides, the position of said retractable stop being adjustable, said retractable stop being so arranged as to be movable in parallel relationship with itself according to that box dimension as considered in parallel relationship with the movement direction of the goods inside the hopper and in such a way that said stop contacts said movable guide whatever be the position thereof, means being provided to move said retractable stop to adjust the position thereof to locate same at such a distance from the opening provided in the hopper that a formed box lying inside said enclosure with the bottom thereof bearing on said slanting plane and with three side walls thereof bearing on said fixed and movable guides and said retractable stop, has the opening thereof in that box zone lying at the uppermost level, facing the hopper opening in such a way that the goods passing through said latter opening fall by gravity into said box, said means further comprising a magazine for prefabricated boxes arranged outside said enclosure and communicating therewith, said magazine being arranged adjacent said fixed guide and so designed that the boxes be stocked in folded condition and in such a way that those portions comprising the box side walls lie substantially at right angle to said slanting plane, means being provided to cause the boxes to pass one at a time from the magazine inside the enclosure while insuring that formation thereof during the transfer, as well as means to operate said retractable stop to retract same below the slanting plane to allow discharging a filled box by gravity.

18. Apparatus as defined in claim 17, in which said magazine is comprised of a holder for said boxes that surface of which the boxes bear on lying in the same plane as the top surface of said slanting plane, a fixed stop extending at right angle to said plane against which bear the boxes, a fixed guide at right angle to said fixed stop to retain the boxes in alignment, and a movable guide extending in parallel relationship with the fixed stop, said stop and guides lying above said plane, and means being provided to bias the movable guide towards the fixed stop.

19. Apparatus as defined in claim 16, which further comprises two parallel movable stops so arranged inside the hopper as to lie each in two end positions, the one position where said stops project relative to the hopper bottom to stop the goods moving by gravity inside said hopper, and a second position in which said stops are retracted to a lower level than said bottom to release said goods, both said stops extending in parallel relationship with said belt side between the hopper inlet and said inlet being slightly larger than the largest diameter of the goods to be boxed by the apparatus, while said second stop lies at a distance from the first stop corresponding to a multiple of said largest diameter, said multiple being smaller than or equal to the number of goods to be fitted inside each box, means being provided to move along a direction substantially at right angle to the hopper bottom and independently from one another, said stops between both end positions thereof.

20. Apparatus as defined in claim 19, in which said movable stops extend over a substantial portion of said hopper from the movable hopper guide at right angle to said belt side, said guide having openings to let said stops through to let said stops extend on either side of said guide in such a way that when said guide is moved farthest away from the fixed guide, said stops close-off said openings.

21. Apparatus as defined in claim 18, in which the means to cause the boxes to pass one at a time from the magazine into the enclosure, comprise a space bounded adjacent the one enclosure angle, by the end of the fixed enclosure guide lying at the uppermost level, the end of the fixed magazine guide arranged adjacent to said end of the enclosure guide and the side surface of a straight cylindrical body which is rotatable about a shaft with an axis at right angle to said slanting plane, the spacing between the ends of the fixed enclosure guide and fixed magazine guide, and said said side surface being slightly larger than the thickness of a box in folded condition, the face of the fixed magazine stop extending substantially tangentially to said side surface and that plane passing through said face intersecting the movable enclosure guide at a slightly higher level than the intersection of said movable guide and retractable movable stop when said stop lies in the position thereof nearest the hopper opening.

22. Apparatus as defined in claim 21, which further comprises a reducing-gear motor to rotate said cylindrical body about the axis thereof, the circuit of said motor being so arranged as to control the energizing thereof by a counting device driven by that switch the operating member of which lies at the hopper inlet and adjusted to trigger said energizing when the predetermined number of goods contained inside a box has run down the hopper, said motor circuit being cut-out by a switch the operating member of which lies inside said enclosure and is fastened to the movable guide below the hopper opening to be operated by the corresponding box side wall when said box is formed.

23. Apparatus as defined in claim 22, in which the means to retract said retractable stop from the enclosure to allow discharging a filled box, are comprised of an electro-magnet fastened to a device arranged underneath said slanting plane and the core of which is associated with said stop, the electro-magnet being so arranged as to be energized from said counting device to retract said stop below said slanting plane, the circuit of that motor driving said cylindrical body comprising such a time delay that the motor will only be energized at the moment where the stop will again lie in the position thereof where the stop projects relative to said slanting plane after having been retracted to let a full box leave the enclosure.

24. Apparatus as defined in claim 17, in which the movable hopper guide and the movable enclosure guide lie in the extension of anoe another and are made of a single part, said part having opposite the enclosure, a flange bearing on said slanting plane, said flange having at least two parallel opening rows aligned in parallel relationship with the lengthwise axis of said belt side and each opening cooperating with a lug fastened to the slanting plane, the spacings between corresponding openings in the guide rows being equal and a function of the size of the goods to be boxed as considered in parallel relationship with the axis thereof, means being provided to immobilize said flange in the selected position thereof relative to said slanting plane.

25. Apparatus as defined in claim 24, in which said third movable guide arranged inside the hopper is comprised of a removable bracket fastened to two blocks fastened to said parallel fixed and movable hopper guides, the size of the bracket used as considered in parallel relationship with said fixed and movable guides, being a function of the diameter of the goods to be boxed and being such that the spacing between the face thereof at right angle to the hopper bottom nearest said belt side and that opening edge in parallel relationship therewith is slightly larger than the diameter of said goods.

26. Apparatus as defined in claim 17, in which the hopper bottom overhangs said enclosure over a distance as considered in parallel relationship with the movement direction of the goods inside the hopper, which is smaller that the largest radius of the goods to be boxed.

27. Apparatus as defined in claim 24, in which said means to move said enclosure rectractable stop in parallel relationship with itself are comprised of two fixed shafts in parallel relationship with one another, with said retractable stop and with said slanting plane, said shafts being arranged underneath said slanting plane on either side of said stop, two parallel shafts at right angle to said fixed shafts on either side of said stop and each bearing at both ends thereof, bearings which are slidable on the fixed shafts along a direction in parallel relationship therewith, said device comprising a plate for supporting the retractable stop electro-magnet, which plate extends between both latter shafts and having at the ends thereof, bearings cooperating with said shafts to let said plate slide along a direction in parallel relationship with said shafts, and a control lever mounted on said supporting plate, the enclosure bottom having parallel openings to let said stop through, the number of openings corresponding to the number of openings provided in each opening row of said movable guide flange and the location of which corresponds to the dimension of the boxes as considered at right angle to said belt side, which can contain goods with a length and a diameter determined respectively by the position of the movable hopper guide and the movable enclosure guide and by the size of the hopper opening as considered in parallel relationship with the movement direction of the goods therein, notches being provided in said slanting plane to bring the control lever to predetermined positions, the number of notches corresponding to said number of openings, each position corresponding to a predetermined length and diameter of the goods to be boxed, means also being provided to energize and hold energized said electro-magnet to retract said stop below said slanting plane while the position of said retractable stop is changed.

28. Apparatus as defined in claim 19, in which that end of said second guide nearest the belt side lies between said belt side and that hopper movable stop nearest said belt side, the spacing between said end and said stop being shorter than the smallest radius of the goods to be boxed by the apparatus.

29. Apparatus as defined in claim 19, in which the means to move each one of both said movable stops are comprised of an electro-magnet fastened underneath said hopper and the core of which is associated with the corresponding stop, and a switch the operating member of which projects relative to the hopper bottom, said operating member being arranged between the hopper inlet and that movable stop nearest thereto, adjacent the hopper fixed guide and at such a distance from the stop that an object bearing on the stop will bear on the switch operating member, the circuit of the switch and the electro-magnet for the first stop nearest the hopper inlet being so arranged as to energize said electro-magnet to bring said stop to said second position when an object fed to the hopper contacts with a generatrix thereof said stop and bears on the operating member of said switch, while the circuit of the electro-magnet for the second stop is so arranged as to energize said electro-magnet to bring the stop to said second position, through a counting device for a predetermined number of goods which is pulsed by said switch.

* * * * *